US007592556B2

(12) United States Patent
Chou et al.

(10) Patent No.: US 7,592,556 B2
(45) Date of Patent: Sep. 22, 2009

(54) VIBRATION SWITCH

(75) Inventors: Cheng-Hao Chou, Taipei Hsien (TW); Wen-Hsiang Lu, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/277,249

(22) Filed: Nov. 24, 2008

(65) Prior Publication Data

US 2009/0183973 A1 Jul. 23, 2009

(30) Foreign Application Priority Data

Jan. 18, 2008 (CH) ..... 2008 1 0065933

(51) Int. Cl.
*H01H 35/14* (2006.01)

(52) U.S. Cl. ..... 200/61.45 R; 200/61.53

(58) Field of Classification Search ..... 200/61.45 R–61.53; 73/488, 504.12, 504.14, 514.01, 73/514.16, 514.35, 514.38
See application file for complete search history.

(56) References Cited

U.S. PATENT DOCUMENTS 4,337,402 A * 6/1982 Nowakowski ..... 307/121
5,092,601 A * 3/1992 Rilling ..... 473/215
5,141,229 A * 8/1992 Roundy ..... 473/570
5,422,628 A * 6/1995 Rodgers ..... 340/573.1
6,741,170 B2 * 5/2004 Alrabady ..... 340/438
7,332,685 B1 * 2/2008 Chou ..... 200/61.45 R

* cited by examiner

*Primary Examiner*—Michael A Friedhofer
(74) *Attorney, Agent, or Firm*—Zhigang Ma

(57) ABSTRACT

The vibration switch includes a housing with a chamber formed thereon and extended in a longitudinal direction. Two attachment means are disposed at two ends of the chamber respectively. Two spring means are received in the chamber and attached to the two attachment means respectively. Two electric contact terminals are electrically connected to the two spring means respectively. An electrically conductive inertial weight received in the chamber and disposed between the two spring means. When the vibration switch is jerked in the longitudinal direction, the inertial weight is capable of moving by inertial force from an initial position to positions where the inertial weight contacts or disengages one of the two spring means, making the vibration switch change from an initial state to a switch-on state or a switch-off state; the inertial weight is capable of returning to the inertial position by the spring force of the two spring means.

9 Claims, 4 Drawing Sheets

VIBRATION SWITCH

BACKGROUND

1. Technical Field

The present invention relates to vibration switches, more specifically, to a vibration switch that is capable of minimizing clattering sounds during use.

2. General Background

A roller/ball vibration switch is capable of instantly changing its switching state when jerked by a force coming from any direction or a predetermined direction. The roller vibration switch generally includes a housing and a ball disposed in the housing. The ball is rollable/movable in the housing when the housing is caused to quiver in an unsteady state so as to effect a change of an electric switching state. However, the ball will produce a clattering sound when it hits against the housing.

Accordingly, there is a need to provide a vibration switch to eliminate or decrease the clattering sound during vibration switch is shaked.

DETAILED DESCRIPTION OF THE EMBODIMENTS

Figure 1:
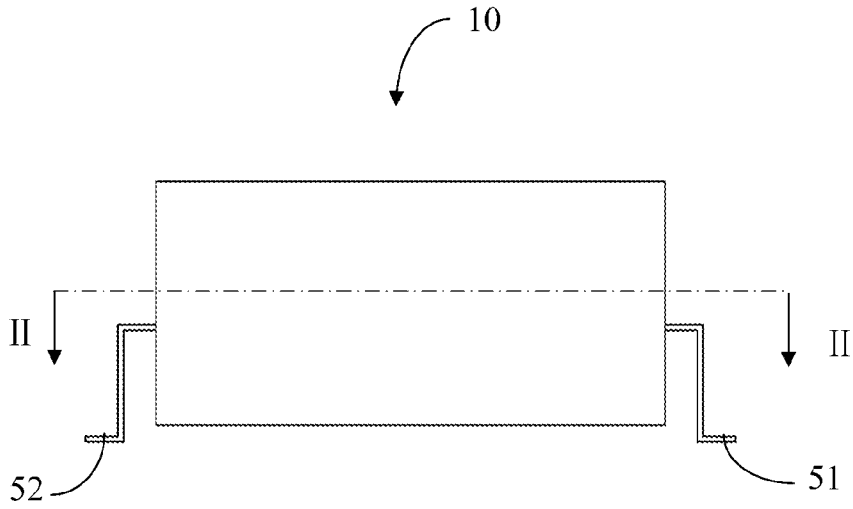
FIG. 1 is an schematic view of a vibration switch in accordance with one embodiment of the present invention.
Figure 2:
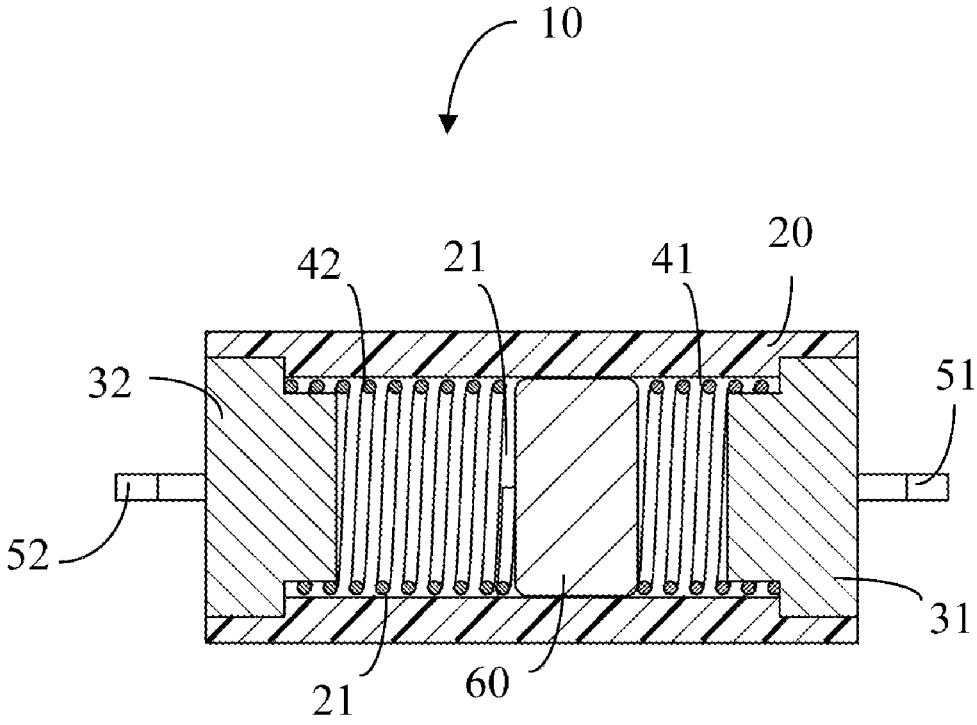
FIG. 2 is a cross-sectional view of the vibration switch of FIG. 1, taken form the line II-II in FIG. 1.

FIGS. 1 and 2 show a vibration switch 10 in accordance with one embodiment of the present invention. The vibration switch 10 includes a housing 20, two side caps 31, 32, a first spring 41, a second spring 42, two contact terminals 51, 52, and an inertial weight 60.

The vibration switch 10, as shown in the FIG. 2, is in a normally closed state. In one embodiment, the housing 20 may be electrically insulating and other parts of the vibration switch 10 may be electrically conductive.

A chamber 21 is formed in the housing 20 and extends in a longitudinal direction. The side caps 31, 32 are of flanged cylinder shapes and each includes a flanged portion and a cylindrical portion. Each of the two side caps 31 and 32 is attached to the housing 20 at one end, respectively, with the flanged portion engaging the chamber 21.

The first spring 41 and the second spring 42 have slightly smaller sizes in the radial direction than that of the chamber 21 and are received in the chamber 21. As shown in FIG. 2, both of the first spring and the second spring 42 are coil springs. One end of the first spring is attached to the cylindrical portion on the side cap 31. One end of the second spring 42 is attached to the cylindrical portion on the side cap 32. The contact terminal 51 is attached to the side cap 31 and the contact terminal 52 is attached to the side cap 32.

The inertial weight 60 may be of a flat cylinder shape and can be constructed of metallic material. The inertial weight 60 has a slightly smaller size in the radial direction than that of the chamber 21 and is received in the chamber 21. The inertial weight 60 is placed between the first spring 41 and the second spring 42 and is kept in an initial balancing position by the spring force of the first spring 41 and the second spring 42. In one embodiment, the inertial weight 60 is attached to the first spring 41 and is biased by the second spring 42. In another embodiment, the inertial weight 60 is biased by the first spring 41 and the second spring 42 and is capable of coming out of contact with the first spring 41 and the second spring 42.

When the vibration switch 10 is shaken in the longitudinal direction, the inertial weight 60 moves by the inertial force and is capable of moving to a plurality of disengaging positions. In the disengaging positions, the inertial weight 60 is out of contact with the first spring 41 or the second spring 42, making the vibration switch 10 change from the normally closed state to an open state.

After the shaking of the vibration switch 10 ceases, the inertial weight 60 returns to the initial balancing position by the spring force of the first spring 41 and the second spring 42, making the vibration switch 10 change from the open state to the normally closed state.

Figure 3:
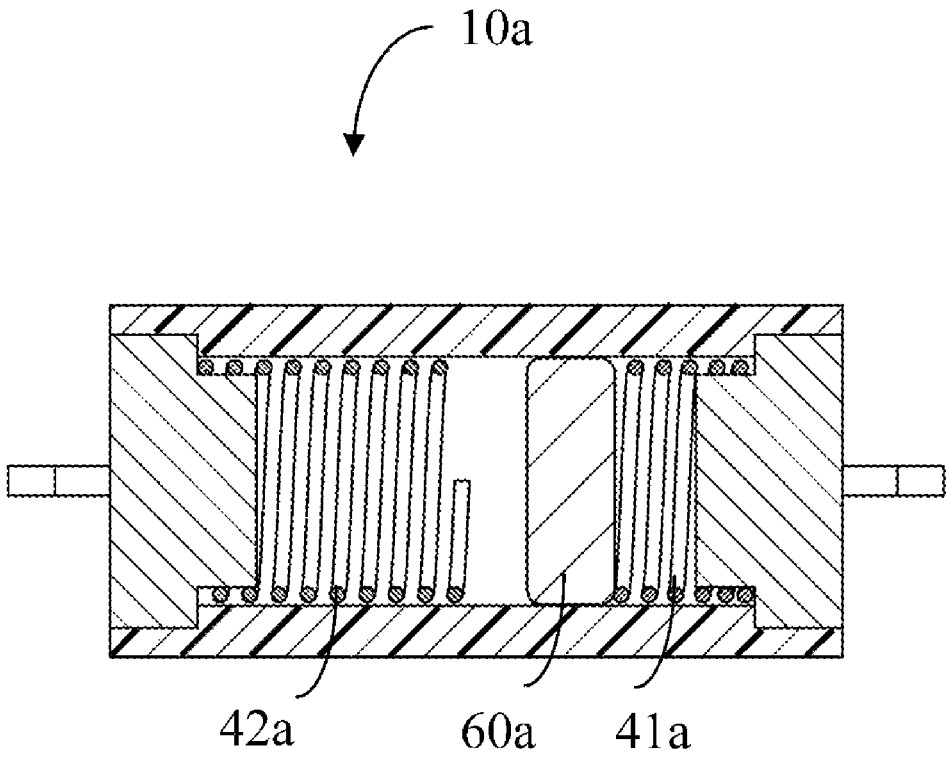
FIG. 3 is a cross-sectional view of a vibration switch in accordance with another embodiment of the present invention.

FIG. 3 shows a vibration switch 10*a* in accordance with another embodiment of the present invention. The vibration switch 10*a* is constructed similarly to the vibration switch 10. The two vibration switches 10 and 10*a* have a structural difference in the relationship between the two springs and the inertial weight. As shown in FIG. 3, an inertial weight 60*a* is attached to a first spring 41*a* and is out of contact with a second spring 42*a*, making the vibration switch 10*a* be in a normally open state.

When the vibration switch 10*a* is shaken in a longitudinal direction, the inertial weight 60*a* is capable of moving from an initial position to a plurality of engaging positions. In the engaging positions, the inertial weight 60*a* contacts the second spring 42*a*, making the vibration switch 10*a* change from the normally open state to a closed state. After the shaking of the vibration switch ceases, the inertial weight 60*a* returns to the initial position by the spring force of the first spring 41*a* and the vibration switch 10*a* returns to the normally open state.

Figure 4:
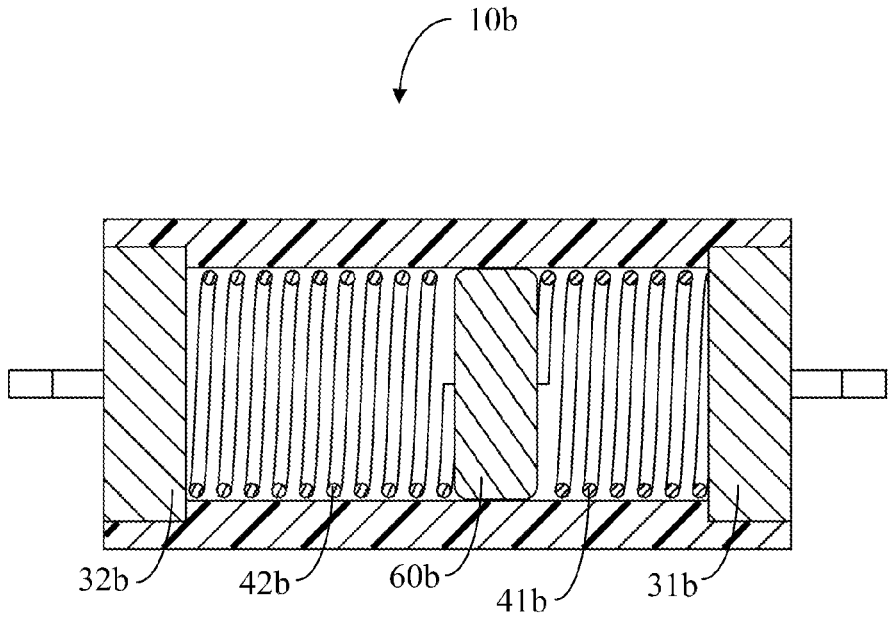
FIG. 4 is cross-sectional view of a vibration switch in accordance with another embodiment of the present invention.

FIG. 4 shows a vibration switch 10*b* in accordance with another embodiment of the present invention. The vibration switch 10*b* is constructed similarly to the vibration switch 10. The only difference between the two vibration switches 10*b* and 10 is that two springs of the vibration switch 10*b* are not attached to the side caps.

When the vibration switch 10*b* is shaken in a longitudinal direction, a inertial weight 60*b* is capable of moving from an initial position to a plurality of disengaging positions. In the disengaging positions, a first spring 41*b* or a second spring 42*b* is capable of returning from a compression state to a normal state and out of contact with a side cap 31*b* or a side cap 32*b*, changing the vibration switch 10*b* from a normally closed state to an open state.

After the shaking of the vibration switch 10*b* ceases, the inertial weight 60*b* returns to the initial position by the spring force of the first spring 41*b* and the second spring 42*b* and the vibration switch 10*b* thus returns to the normally closed state.

Vibration switches described above are constructed with two springs and an inertial weight enclosed by a housing and two side caps, in other words, the two springs and the inertial weight are enclosed by a three-part assembly. However, when needed, other types of structure may be used for enclosing the two springs and the inertial weight, such as a two-part assembly.

During the vibration switches are shaken, the inertial weight moves along the longitudinal direction and dose not hit against the housing, clattering sound is thus eliminated.

While various embodiments have been described and illustrated, the invention is not to be construed as being limited thereto. Various modifications can be made to the embodiments by those skilled in the art without departing from the true spirit and scope of the invention as defined by the appended claims.

What is claimed is:

1. A vibration switch comprising:

an electrically insulating housing with a chamber formed therein and extended in a longitudinal direction;

two attachment means disposed at one end of the chamber respectively;

two spring means received in the chamber and attached to one of the two attachment means respectively;

two electric contact terminals electrically connected to one of the two spring means respectively; and an electrically conductive inertial weight received in the chamber and disposed between the two spring means;

wherein when the vibration switch is jerked in the longitudinal direction, the inertial weight is capable of moving by inertial force from an initial position to positions where the inertial weight contacts or disengages one of the two spring means, making the vibration switch change from an initial state to a switch-on state or a switch-off state; the inertial weight is capable of returning to the inertial position by the spring force of the two spring means.

2. The vibration switch according to claim 1, wherein the two spring means are coil springs.

3. The vibration switch according to claim 1, wherein the inertial weight is attached to one of the two spring means and is out of contact with the other spring means, making the vibration switch be in a normally open state.

4. The vibration switch according to claim 1, wherein the inertial weight is attached to one of the two spring means and contacts the other spring means, making the vibration switch be in a normally closed state.

5. The vibration switch according to claim 1, wherein the inertial weight contacts the two spring means, making the vibration switch be in an initial switch-on state, and is capable of disengaging either of the two spring means.

6. A vibration switch comprising:

an electrically insulating housing with a chamber formed therein and extended in a longitudinal direction;

two electrical conductive enclosure means disposed at one end of the chamber;

two electric contact terminals attached to one of the two enclosure means respectively;

two spring means movably received in the chamber; and an inertial electrically conductive weight received in the chamber and disposed between the two spring means and kept in an initial balancing position by the spring force of two spring means;

wherein, when the vibration switch is jerked in the longitudinal direction, the inertial weight is capable of moving from the initial balancing position to positions where one of the two spring means is capable of returning from a compression state to a normal state and disengaging one of the two enclosure means, making the vibration switch change from an initial switch-on state to a switch-off state; the inertial weight is capable of returning to the initial balancing position by the spring force of the two spring means.

7. The vibration switch according to claim 6, wherein the two spring means are coil springs.

8. The vibration switch according to claim 6, wherein the inertial weight is attached to the two spring means.

9. The vibration switch according to claim 6, wherein the inertial weight is capable of disengaging the two spring means.

* * * * *